US005758223A

United States Patent [19]

Kobayashi et al.

[11] Patent Number: 5,758,223

[45] Date of Patent: May 26, 1998

[54] AUTOMATIC PROCESSING MACHINE FOR SILVER HALIDE PHOTOGRAPHIC LIGHT-SENSITIVE MATERIAL

[75] Inventors: Hiroaki Kobayashi; Yutaka Ueda; Manabu Nakahanada; Moeko Hagiwara, all of Hino, Japan

[73] Assignee: Konica Corporation, Tokyo, Japan

[21] Appl. No.: 705,397

[22] Filed: Aug. 29, 1996

[30] Foreign Application Priority Data

Sep. 4, 1995 [JP] Japan ..... 7-226636

[51] Int. Cl.[6] ..... G03D 3/02

[52] U.S. Cl. ..... 396/604; 396/627

[58] Field of Search ..... 396/627, 626, 396/617, 604; 118/691, 315; 347/13, 14

[56] References Cited

U.S. PATENT DOCUMENTS 4,837,593 6/1989 Hen ..... 396/617

5,574,530 11/1996 Sanada ..... 396/604

*Primary Examiner*—D. Rutledge

*Attorney, Agent, or Firm*—Frishauf, Holtz, Goodman, Langer & Chick, P.C.

[57] ABSTRACT

An apparatus for processing a silver halide photographic material which is exposed to a light, comprises a supplying head on which plural jetting orifices are provided. A processing solution is supplied through a space from the plural jetting orifices onto the silver halide photographic material so that plural solution dots are formed on the silver halide photographic material. The plural jetting orifices are provided in such an arrangement that, when the amount of the processing solution supplied through each of the plural jetting orifices is a minimum amount, each solution dot on the silver halide photographic material has a dot area S and a overlapping area D in which neighboring solution dots are overlapped with each other and a degree of overlapping defined by a formula (D/S) is not less than 0.2.

11 Claims, 6 Drawing Sheets

AUTOMATIC PROCESSING MACHINE FOR SILVER HALIDE PHOTOGRAPHIC LIGHT-SENSITIVE MATERIAL

BACKGROUND OF THE INVENTION

The present invention relates to an automatic processing machine, for silver halide photographic light-sensitive material, which processes the silver halide photographic light-sensitive material (hereinafter, it may simplily be referred to as "light-sensitive material") with the processing solution.

Recently, movement of environment restriction has become popular. In the photographic industry too, it has been a critical issue how to achieve reduction of photographic processing effluent.

In addition, due to the rapid proliferation of mini-labs, the amount of silver halide photographic light-sensitive material processed per day tends to be reduced. Accordingly, daily solution renewal ratio of a processing tank solution tends to be reduced. Specifically, in the case of processing solutions for developing, when the renewal ratio of the processing tank solution is reduced, a problem that deterioration of processing tank solution due to air oxidation become noticeable so that stable processing performance cannot be maintained.

As a means for overcoming such problems, Japanese Patent Publication Open to Public Inspection (hereinafter, referred to as Japanese Patent O.P.I. Publication) No. 324455/1994 discloses a method to directly feed only the necessary amount of processing solution onto the emulsion surface of the silver halide photographic light-sensitive material (hereinafter, referred to merely as "light-sensitive material")

It is sure that the technology disclosed in Japanese Patent O.P.I. Publication No. 324455/1994 can improve storage stability of the processing solution (specifically, in the case of a color developing solution) compared with conventional methods, due to feeding aforesaid processing solution which processes the light-sensitive material onto the emulsion surface of the light-sensitive material from a processing solution container which houses the processing solution tightly close through a gas phase. However, it has turned out that the above-mentioned technology practically has problems to be overcome.

Namely, though the processing solution amount used in accordance with the above-mentioned technology is less compared with conventional systems (for example, a processing solution dipping system), the processing solution fed onto the emulsion surface of the light-sensitive material is completely carried over into the next downstream tank (for example, a bleach-fixing tank). Accordingly, there may be cases when the carrying over amount of the developing agent becomes larger compared with conventional tank development systems. Therefore, it is natural that the processing performance reduction in the following tanks occurs due to carry-over of the processing solution when the amount of processing solution fed becomes greater.

Image gradation by means of an ink jet recording apparatus is ordinarily made utilizing dot density. Accordingly, solution drips may sometimes be applied to spaces between each dot. When images are formed by the drip of the processing solution onto the light-sensitive material and by developing, portions with no solution drips are applied or only a little solution drips are applied in accordance with the conventional methods, spaces where the processing solution is not applied occurred so that uneven development occurs.

In addition, when the amount of dripping is small too, spaces occur where the processing solution does not exist occurs between each dot, causing uneven development. Even if excessive amount of solution is dripped in order to prevent the above-mentioned problem, it turned out that solution drips are bound together for coming close, still causing development unevenness. In addition, it turned out that this technology has another problem in that the amount of carry-over to the next downstream tank increases.

In addition, it is so designed one dot of ink dripped on a recording surface by an ink jet recording device results in a surface of dispersion having double to 4 time diameter compared with the diameter of the solution drip of aforesaid ink. However, when a developing solution is dripped on a light-sensitive material, dispersion of the solution drip on the light-sensitive material is almost the same as that of the initial solution drip. Accordingly, gaps between each dot easily occurs. As a result, the problem that unevenness occurs on images occurs.

In addition, in the case of an ink jet recording device, another problem has newly been found that the temperature of the processing solution easily fluctuates since the processing solution is fed through a gas phase. Namely, it has already been discovered that the temperature and the humidity in the vicinity of the processing solution change between the starting time of the automatic processing machine and after some duration of operation because a processing solution is fed through a gas phase. In aforesaid system, the above-mentioned influence is specifically great. Actual climate conditions in the marketwhere aforesaid automatic processing machine is placed are very variable in terms of temperature and humidity. Accordingly, overcome of this problem is essential.

Accordingly, a first object of the present invention is to minimize the consumption of processing agent components used for developing. A second object of the present invention is to improve for the occurrence of uneven development. A third object of the present invention is to provide an automatic processing machine capable of stabilizing processing fluctuations.

The present inventors studied laboriously in order to attain the above-mentioned objects. As a result, they discovered that constitutions described in the Claims can overcome the above-mentioned problems.

The above object of the present invention can be attained by an apparatus for processing a silver halide photographic material which is exposed to a light, comprising a supplying head on which plural jetting orifices are provided. A processing solution is supplied through a space from the plural jetting orifices onto the silver halide photographic material so that plural solution dots are formed on the silver halide photographic material. The plural jetting orifices are provided in such an arrangement that, when the amount of the processing solution supplied through each of the plural jetting orifices is a minimum amount, each solution dot on the silver halide photographic material has a dot area S and a overlapping area D in which neiboring solution dots are overlapped with each other and a degree of overlapping defined by a formula (D/S) is not less than 0.2 (structure 1).

Due to a structure 1, by setting the minimum value of the dripping amount of the processing solution per unit area to be 0.2 or more in terms of the degree of overlapping of the solution drop, the amount of processing solution can be reduced, and concurrently with this, uneven development can be prevented.

In addition, the above-mentioned object of the present invention was attained by an automatic processing machine for silver halide photographic light-sensitive material provided with a feeding means which feeds a processing solution which processes said silver halide photographic light-sensitive material through a gas phase and an adjusting means which adjusts the amount of processing solution fed onto the emulsion surface of said silver halide photographic light-sensitive material, wherein the above-mentioned feeding means (supplying means) has plural rows of orifices (jetting holes) and said adjusting means changes the amount of said processing solution drip in accordance with image signals while said dripping amount per unit area is uncontinuously changed (structure 2).

Due to Structure 2, when the fed amount of processing solution is regulated (specifically, image signals corresponding to low density) in accordance with image signals which are recorded on the light-sensitive material, plural orifices rows are provided, the dripping amount of processing solution per unit area is changed uncontinously and aforesaid dripping amount is caused to correspond with image signals Accordingly, the amount of processing solution in a low density portion can be reduced and uneven development can be minimized.

A method to cause an amount of dripping of the processing solution of the present invention per unit area to be uncontinuous changed amount is to take an outputted signal from an image reading apparatus in a processing solution feeding means adjusting means and to feed the prescribed amount by means of a processing solution regulation means onto a light-sensitive material through a gas phase. In the present invention, other methods may be used: a position of light-sensitive material is sensed by means of an infrared sensor for recognizing an image portion and a non-image portion and at least a prescribed amount of processing solution may be dripped on an image portion while not dripping on a non-image portion. Preferably, the amount of processing solution fed may be changed stepwisely in accordance with an image signal.

Namely, in the present invention, the above-mentioned image density is not corresponded to the amount of processing solution by 1:1 but that the density area of the sensitometry is divided into one or plural areas and an amount of agent necessary to obtain the maximum density of the divided area is to be fed. The number of area to be divided is preferably 1–30 steps, and preferably 3–10 steps. In addition, a prescribed amount od developer and the amount of processing solution can be calculated from the density value of the maximum density among image density G, G and R.

Due to a structure in which the above-mentioned processing solution for silver halide photographic light-sensitive material is used for color developing solution and/or bleaching solution, it is not necessary to feed said processing solution onto white background portions. Accordingly, the occurrence of stains due to oxidized product of the color developing agent can completely be prevented.

In addition, it is effective that the above-mentioned processing solution for silver halide photographic light-sensitive material is specifically for color developing from the viewpoint of developing processing.

Due to a structure that a structure that the projected line density of the plural of the above-mentioned orifices row is larger than the dot line density of the processing solution in the head advancing direction in the case of minimum dripping amount, uneven development can be prevented both in low density and high density areas. Accordingly, stable developability can be obtained even if processing temperatures fluctuate.

The row of orifice of the present invention is at least 2, and preferably 2–6 rows. Each row preferably makes zigzag formation.

The degree of overlapping of the solution drips is preferably 0.2 or more and 4 or less, and more preferably 0.3 or more and 3 or less.

An image signal in the present invention may be an inputted signal including a measured light density (an integral density) read by a conventional image reading device and a digital image signal housed in a photo CD. In addition, an outputted signal such as an exposure amount onto a light-sensitive material which has already been operated.

In the present invention, when the image signal is an inputted signal such as the above-mentioned measured light density (the integral density), the integral density is necessary to be converted to the density of each color of yellow, magenta and cyan (analysis density) (see Japanese Patent O.P.I. Publication No. 88344/1992). Furthermore, a means for converting the above-mentioned Y, M and C analysis density to exposure a light-sensitive material to B, G and R light is required. As a method for converting from the above-mentioned analysis density to the amount of exposure to light, aforesaid analysis density may be converted in accordance with characteristics curve between the amount of exposure to light for each of R, G and B and the analysis density (coloring density) for a Pan layer, an Ortho layer and a Regular layer respectively, or also may be converted from the relationship between the amount of exposure and the measurement results of measurement density wherein a developed light-sensitive material was measured by a densitometer as an analysis density.

As a practical means for adjusting the amount of color developing agent in the present invention, any of the following methods may be used:

(A) adjusting the amount of feeding by adjusting the number of sprayed dot per unit area in the same manner as in a conventional ink jet type.

(B) adjusting the amount of feeding by adjusting the number of spraying (frequency) the processing solution per unit time (C) adjusting the amount of feeding by adjusting the unit amount of spraying the processing solution

DETAILED DESCRIPTION OF THE PREFERRED EMBODIMENT

Figure 1:
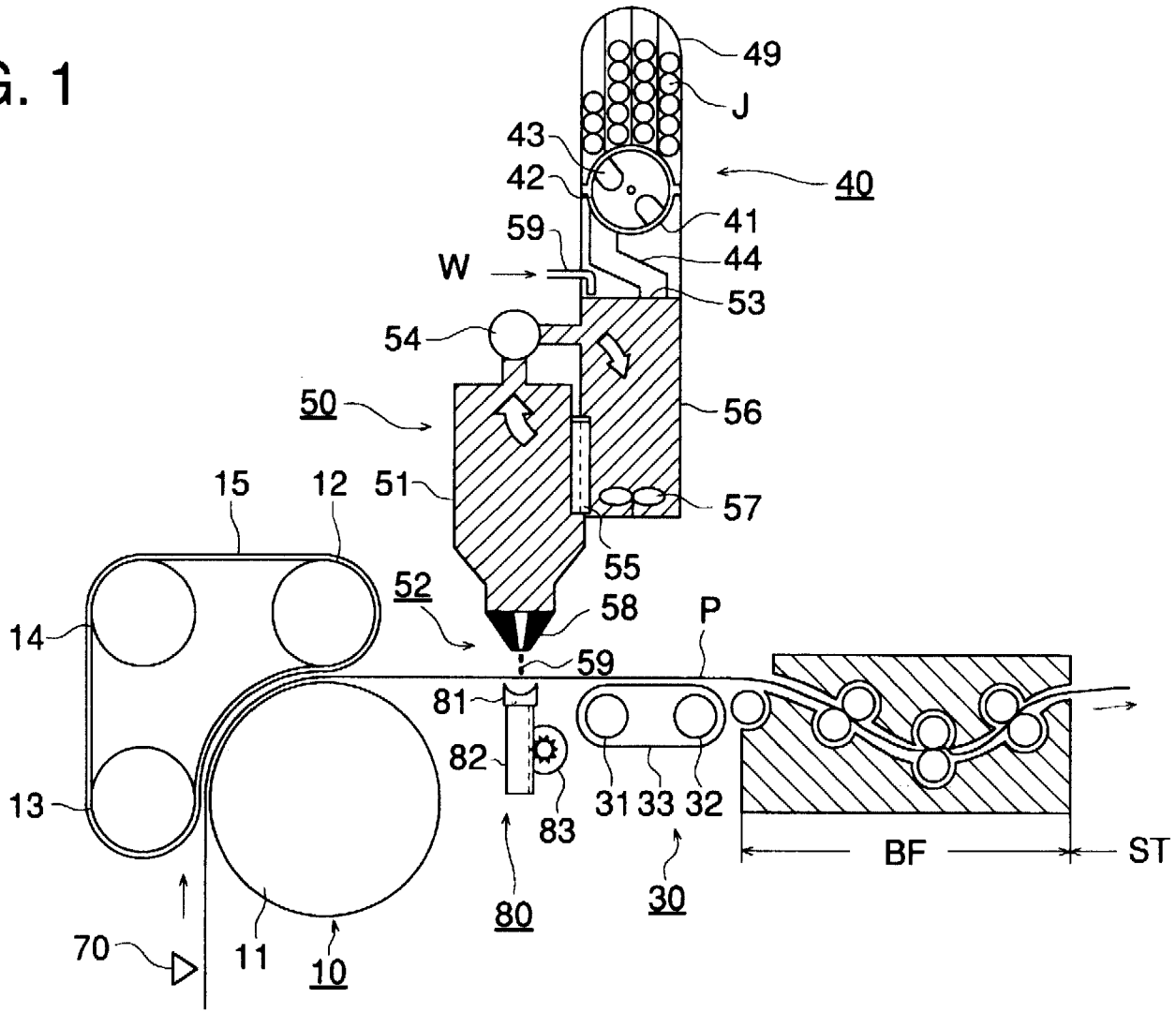
FIG. 1 shows schematic block diagram of the main portions of the automatic processing machine in Example 1.

Hereinafter, preferred embodiments of the present invention will be explained.

[Processing solution feeding means]

In the present invention, as a processing solution feeding means which feeds the processing solution onto the emulsion surface of light-sensitive material through a gas phase, a processing solution splashing means which splashes the processing solution onto the light-sensitive material through a gas phase and a processing solution coating means which coats the processing solution onto the emulsion surface of light-sensitive material through a gas phase, such as a curtain coater are cited. As the processing solution splashing means which splashes the processing solution onto the light-sensitive material through a gas phase, that which has the identical structure as the ink jet head section of an ink jet printer, that disclosed in Japanese Patent O.P.I. Publication No. 324455/1994 wherein pressure is generated in a splashing means and cause the processing solution splashing means feeding the processing solution onto the light-sensitive material through a gas phase and a spray bar which causes the processing solution splashing due to solution pressure applied to the splashing means for feeding the processing solution onto the light-sensitive material through a gas phase. As the processing solution splashing means wherein the processing solution is fed onto the light-sensitive material through a gas phase by means of a structure having an identical structure to the ink jet head section of the ink jet printer, that which feeds the processing solution by vibration and that which feeds the processing solution due to sudden rise of temperature, both of which are preferable because they can control the amount of feeding the processing solution and can select the processing position of the light-sensitive material.

As the processing solution feeding means, any methods including that wherein the processing solution is fed onto the light-sensitive material from a bar-shaped feeding head through a gas phase, that wherein the processing solution is fed onto the light-sensitive material from a surface-shaped feeding head through a gas phase or that wherein the processing solution is fed onto the light-sensitive material from a dot-shaped feeding head through a gas phase. In addition, when the light-sensitive material is a sheet type, the processing solution may be fed onto the light-sensitive material from a feeding head through a gas phase while the relationship between the light-sensitive material and the feeding head is fixed. However, it is better to feed the processing solution onto the light-sensitive material from a feeding head through a gas phase while the relationship between the light-sensitive material and the feeding head is being shifted, because the processing solution can sufficiently be fed onto the light-sensitive material even when the feeding head is small. In addition, when the bar-shaped feeding head is used, the feeding head may be moved. In this occasion, it is preferable that the bar-shaped feeding head is moved in a direction other than a parallel direction with the bar-shaped feeding head. Specifically, it is preferable to move the light-sensitive material perpendicular to the feeding head in order to keep the processing time constant. With regard to the processing solution splashing means, when the processing solution is splashed onto the light-sensitive material from the feeding head through a gas phase while shifting the position relationship between the feeding head and the light-sensitive material, the number of splashing the processing solution onto the light-sensitive material from the feeding head through a gas phase per second is preferably once or more and specifically preferably 10 or more times, in order to sufficiently feed the processing solution onto the surface of the light-sensitive material. In addition, in order to splash the processing solution from the feeding head, $1\times10^6$ times or less is preferable and $1\times10^5$ times or less is more preferable.

When the processing solution feeding means feeds the processing solution through a feeding port, any forms such as circular, square and elliptical may be used for the form of feeding port. The area of such feeding port is preferably $1\times10^{-11}$ $m^2$ or more and specifically preferably $1\times10^{-10}$ $m^2$ or more, in order not that the processing solution is clogged even when it is slightly dried. In addition, the area of such feeding port is preferably $1\times10^{-8}$ $m^2$ or less and specifically preferably $1\times10^{-6}$ $m^2$ or less, in order to uniformly feed the processing solution onto the light-sensitive material. In addition, the interval between feeding ports is $5\times10^{-6}$ $m^2$ or more in terms of the average distance between two adjacent edge of the feeding port, from viewpoint of the strength of the feeding port. In addition, $1\times10^{-3}$ $m^2$ or less is specifically preferable in order to sufficiently feed the processing solution onto the surface of the light-sensitive material.

The distance between the feeding port and the emulsion surface of the light-sensitive material after processing is preferably 50 μm or more (specifically 1 mm or more) and 10 mm or less (specifically 5 mm or less) in order to control this distance simply.

[Heating means]

The temperature of light-sensitive material heated by a heating means may be 40° C. or less. However, 40° C. is preferable and 45° C. or more is more preferable and 50° C. or more is specifically more preferable. In addition, 150° C. or less is preferable from viewpoint of heat-durability of the light-sensitive material and control ease of processing and 100° C. or less is specifically preferable and 90° C. or less is specifically more preferable in order to prevent boiling of the processing solution.

As a heating means which heats the light-sensitive material, a transmission heating means which causes a heating drum or a heating belt being brought into contact with the light-sensitive material for transmitting heat, a convection heating means which heats the light-sensitive material by the convection of the drier and an irradiation and heating means which heats the light-sensitive material due to irradiation of an infrared beam and high frequency electromagnetic waves.

It is preferable that the automatic processing machine has a heating control means which control in such a manner that the above-mentioned heating means heats the light-sensitive material when the silver halide photographic light-sensitive material exists at a point where the heating means heats, in order to prevent unnecessary heating. The above-mentioned structure can be attained by having a conveyance means which conveys the silver halide photographic light-sensitive material at a prescribed conveyance speed and a light-sensitive material sensing means which senses the existence of the above-mentioned silver halide photographic light-sensitive material at a prescribed position on upstream side of the conveyance direction in the above-mentioned conveyance means wherein the above-mentioned heating control means conducts controlling in accordance with sensing by the above-mentioned light-sensitive material sensing means. In this occasion, it preferable that control is conducted in such a manner that the above-mentioned heating means conducts a prescribed heating since a prescribed time passed after the above-mentioned light-sensitive material sensing means sensed existence of the silver halide photographic light-sensitive material at the above-mentioned prescribed position from non-existence until a prescribed time passed after the above-mentioned light-sensitive material sensing means sensed non-existence of the silver halide photographic light-sensitive material at the above-mentioned prescribed position from existence.

[Stirring means]

As a stirring means, a rotator which rotates due to an inducing magnetic field and a propeller provided on a rotation shaft which rotates due to a motor are cited.

[Circulation means]

A circulation means may be a circulation pump used for conventional automatic processing machines.

The silver halide photographic light-sensitive material is provided with a silver halide emulsion layer on a support. The silver halide emulsion layer may be provided on either side or both sides. The emulsion surface of the silver halide photographic light-sensitive material is a side where the silver halide emulsion layer is provided. It may be provided on a front surface, a rear surface or both surfaces.

[Solid processing agent supplying means]

Hereinafter, supplying of a solid processing agent will be explained. However, in the present invention, conventional liquid type processing solution for replenishing can also be used.

As a solid processing agent supplying means which supplies a solid processing agent to the processing solution container, for example, when the solid processing agent is a tablet, conventional methods such as those described in Japanese Utility Publication Open to Public Inspection (hereinafter, Japanese Utility O.P.I. Publication) Nos. 137783/1988, 97522/1988 and 85732/1989 are cited. However, any means can be used provided that the tablet is supplied to the processing solution container. When the solid processing agent is granule or powder, gravity dripping means described in Japanese Utility O.P.I. Publication Nos. 81964/1987 and 841/51/1988 and Japanese Patent O.P.I. Publication No. 292375/1989 and screw or a tap means described in Japanese Utility O.P.I. Publication Nos. 10515/1988 and 195345/1988 are cited. However, the present invention is not limited thereto.

The amount of the solid processing agent supplied at one time is preferably 0.1 g or more from viewpoint of durability of the solid processing agent supplying means and accuracy of charging amount every time. On the other hand, it is preferably 50 g or less from viewpoint of dissolution time.

[Replenishing water]

Replenishing water is a solution having an effect to dissolve the solid processing agent fed to the processing solution container. Ordinarily, the replenishing water is water.

[Solid processing agent]

The solid processing agent is a solid processing agent containing processing agent components of the processing solution which processes the light-sensitive material. The solid processing agent includes powder, tablet, pill and granule. In addition, it may be laminated with a water-soluble lamination such as a water-soluble polymer on the surface of the processing agent as necessary. Powder in the present invention represents an aggregate of fine particle crystal. Granule in the present invention represents granuled powder wherein its particle size is preferably 50–500 μm. Tablet in the present invention represents powder of granule which are compressed and molded in a certain form. Pill in the present invention represents a rounded material due to granulating or tableting (including potato form and spherical form). In the present invention, among the above-mentioned solid processing agent type, either of granule, tablet or pill is preferable since the occurrence of dust or foreign materials during handling is little and supplying accuracy is correct. Furthermore, of these, the tablet is preferably used since replenishing accuracy is high, handling is easy, its density does not change rapidly due to sudden dissolution and the effects of the present invention are favorably provided.

In order to solidify the photographic processing agent, any means, such as a means to knead a condensed-solution, fine particle or granule photographic processing agent and a water-soluble binder and to mold or a method to form a laminated layer by spraying a water-soluble binder on the surface of a temporarily molded photographic processing agent (see Japanese Patent O.P.I. Publication No. 29136/1992, 85533/1992 through 85536/1992 and 172341/1992).

The preferable tablet manufacturing method is to form the tablet by conducting a tableting process after granulating powder solid processing agent. This method has a merit that photographic performance becomes more stable compared with a solid processing agent wherein solid processing agent components are simply mixed and a tablet is formed by a tableting process, since dissolubability and storage stability is improved. As a granulation method for preparing a tablet, granule or a pill, conventional methods including a transmission granulation method, an extrusion granulation method, a compression granulation method, a crushing granulation method, a stirring granulation method, a fluid bed layer granulation method and a spray and drying granulation method can be used. In addition, when granulating, it is preferable to add a water-soluble binder by 0.01–20 wt %. As a water-soluble binder, celluloses, dextrins, saccharide alcohols, polyethylene glycols and cyclodextrin are preferable.

These materials are preferably 0.5% or more and 20% or less against the weight of the solid processing agent.

Next, when forming a tablet by compressing the resulting granule, conventional compressing machines, such as an oil-pressurers, a single pressure tableting machines, a rotary tableting machines and pricketing machines can be used. Preferably, it is preferable to separate each component such as an alkaline agent and a preserver and granulate them independently.

The tablet processing agents can be produced by conventional methods as described in Japanese Patent O.P.I. Publication Nos. 61837/1976, 155038/1979 and 88025/1977 and British Patent No. 1,213,88. The granule processing agents can be produced by conventional methods described in Japanese Patent O.P.I. Publication Nos. 109042/1990, 109043/1990, 39735/1991 and 39739/1991. The powder processing agents can be produced by conventional methods described in Japanese Patent O.P.I. Publication No. 133332/1979, British Patent Nos. 725,892 and 729,862 and German Patent No. 3,733,861.

[Processing steps]

Each means of the present invention may be used any processing step which processes the light-sensitive material with the processing solution. However, it is preferable to use that each means is used in a developing step, a color developing step, a bleaching step or a bleach-fixing step is preferable.

[Color developing process]

Time for the color developing step is defined to be time since a color developing solution is firstly fed onto a portion of the light-sensitive material initially until a time when the processing solution of the next step is fed onto the portion of the light-sensitive material or until the portion of the light-sensitive material is immersed in the processing solution of the next step. The time for the color developing step is 5 seconds or more, and specifically 8 seconds or more from viewpoint of sufficiently and stably conducting the color developing step. In addition, 180 seconds or less and specifically 60 seconds or less is preferable since provision of adverse influence on the light-sensitive material due to deterioration or drying of the color developing solution fed onto the light-sensitive material can be prevented.

In the color developing step, plural processing solution feeding means may be provided so that the processing solution may be fed to the light-sensitive material from the first processing solution feeding means and then another processing solution may be fed from the second processing solution feeding means onto the light-sensitive material wherein the processing solution is fed from the first processing solution feeding means. In this occasion, the following three preferable embodiments are cited.

The first embodiment is that, when the light-sensitive material is subjected to color developing by a color developing agent which becomes active at pH of 7 or more, the first processing solution feeding means feeds the processing solution containing a color developing agent whose pH is 6 or less onto the light-sensitive material and the second processing solution feeding means feeds a color developing processing solution whose pH is 7 or more. Due to the above-mentioned structure, alkaline components whose diffusion speed are high are supplied and diffused after the color developing agent whose diffusion speed is slow is sufficiently diffused through the thickness direction of the light-sensitive material. Accordingly, problems such as uneven developing due to noticeable difference of developing starting time in the thickness direction of the light-sensitive layer can be prevented. When the light-sensitive material is a multi-layered color photographic light-sensitive material, coloring property of each primary colors becomes disrupted if the developing starting time is noticeably different in the thickness direction of each light-sensitive layer. Therefore, it is specifically useful. In the case of multi-layered light-sensitive materials having 5 or more layers and specifically 10 or more layers, such effect becomes extremely great.

The second embodiment is that the first processing solution feeding means feeds water to the light-sensitive material and that the second processing solution feeding means feeds the color developing processing solution to the light-sensitive material. Due to this structure, the color developing processing solution is fed after the light-sensitive material is provided with water and is sufficiently swollen. Therefore, components whose diffusion speed is slow in a hardened light-sensitive material are diffused at sufficiently high speed. As a result, problems such as uneven development due to noticeable difference of developing starting time in a thickness direction of a light-sensitive layer can be decreased.

The third embodiment is that the first processing solution feeding means feeds water containing an oxidant such as hydrogen peroxide onto the light-sensitive material and that the second processing solution feeding means feeds a color developing processing solution.

The color developing agent is preferably a p-phenylenediamine-containing compound having a water-solubilizing group, p-phenylenediamine-containing compounds having at least one above-mentioned water-solubilizing group on an amino group or a benzene nucleus. Practically, $—(CH_2)_n—CH_2OH$, $—(CH_2)_m—NHSO_2—(CH_2)_nCH_3$, $—(CH_2)_m—O—(CH_2)_n—CH_3$, $(CH_2CH_2O)_nC_mH_{2m+1}$ (wherein m and respectively represent 0 or more integer), —COOH group and $—SO_3H$ group. Practical examples of illustrated compounds of color developing agents preferably used include (C-1) through (C-16) described on pp. 7–9 in Japanese Patent O.P.I. Publication No. 86741/1992.

If compounds represented by the following Formulas [H] or [B] are incorporated in a color developer, merits that processing is photographically stable and fogging occurring is little are resulted in. In addition, in the case of a solid processing agent, storage stability of the solid processing agent is improved compared with other compounds.

Formula H

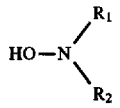

wherein $R_1$ and $R_2$, which are not hydrogen atoms concurrently, independently represent an alkyl group, an aryl group, an R', a —CO— group or a hydrogen atom; an alkyl group represented by $R_1$ and $R_2$ may be the same or different, wherein alkyl groups having 1 to 3 carbon atoms are preferable; the above-mentioned alkyl groups may further have a carboxylic acid group, a phosphoric acid group, a sulfonic acid group or a hydroxylic acid group; R' represents an alkoxy group, an alkyl group or an aryl group; an alkyl group and an aryl group represented by $R_1$, $R_2$ and R' include those having a substituent; $R_1$ and $R_2$ may be linked together for forming a ring; and they may form a heterocycle such as pyperidine, pyridine, triazine or morphorine.

Formula B

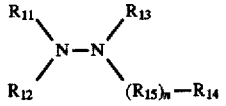

wherein $R_{11}$, $R_{12}$ and $R_{13}$ independently represent a hydrogen atom, a substituted or unsubstituted alkyl group, aryl group or heterocycle; $R_{14}$ represents a hydroxy group, a hydroxyamino group, a substituted or unsubstituted alkyl group, aryl group, heterocycle, alkoxy group, aryloxy group, carbamoyl group and amino group; a heterocycle, which may be saturated or unsaturated, is a 5-membered to 6-membered ring composed of C, H, O, N, S and a halogen atom; $R_{15}$ represents a divalent group selected from —CO—, $—SO_2—$ or —C(=NH)—; n represents 0 or 1; when n is specifically 0, $R_{14}$ represents a group selected from an alkyl group, an aryl group, a heterocycle; and $R_{13}$ and $R_{14}$ may form a heterocycle in combination.

Among compounds represented by Formula [H], compounds represented by the following Formula [D] is specifically preferable.

Formula D

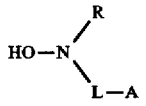

wherein L represents an alkylene group, A represents a carboxyl group, a sulfo group, a phosphono group, a phosphinic group, a hydroxyl group, an amino group, an ammonio group, a carbamoyl group or a sulfamoyl group; R represents a hydrogen atom or an alkyl group; all of L, A and R, which may be substituted or unsubstituted, include straight chained or branched chained; and L and R may be linked together for forming a ring.

Compounds represented by Formula [D] will now be explained further in detail. In the Formula, L represents a straight-chained or branched chained alkylene group, which may be substituted, having 1 to 10 carbon atoms. The carbon atom is preferable 1 to 5. Practically, a methylene group, an ethylene group, a trimethylene group and a propylene group are preferably cited. As a substituent, a carboxyl group, a sulfo group, a phosphono group, a phosphinic acid group, a hydroxyl group, an ammonio group which may be alkyl-substituting are represented. A carboxyl group, a sulfo group, a phosphono group and a hydroxyl group are preferably cited. A represents a carboxyl group, a sulfo group, a phosphono group, a phosphinic acid group, a hydroxyl group, an amino group which may be subjected to alkyl-substituting, an ammonio group, a carbamoyl group or a sulfamoyl group. Of these, a carboxyl group, a sulfo group, a hydroxyl group, a phosphono group and a carbamoyl group which may be subjected to alkyl-substituting are preferably cited. As examples of —L—A, a carboxymethyl group, a carboxyethyl group, a carboxypropyl group, a sulfoethyl group, a sulfopropyl group, a sulfobutyl group, a phosphonomethyl group, a phosphonoethyl group and a hydroxyethyl group are preferably cited. In addition, a carboxymethyl group, a carboxyethyl group, a sulfoethyl group, a sulfopropyl group, a phosphonomethyl group and a phosphonoethyl group are preferably exemplified. R represents a hydrogen atom, a straight-chained or branched-chained alkyl group having 1–10 carbon atoms which may be substituted. The carbon atom is preferably 1–5. A substituent represents a carboxyl group, a sulfo group, a phosphono group, a phosphinic acid group, a hydroxyl group, an amino group which may be subjected to alkyl-substituting, an ammonio group, a carbamoyl group or a sulfamoyl group. The number of substituent may be two or more. R represents a hydrogen atom, a carboxymethyl group, a carboxyethyl group, a carboxypropyl group, a sulfoethyl group, a sulfopropyl group, a sulfobutyl group, a phosphonomethyl group, a phosphonoethyl group and a hydroxyethyl group. Specifically, a hydrogen atom, a carboxymethyl group, a carboxyethyl group, a sulfoethyl group, a sulfopropyl group, a phosphonomethyl group and a phosphonoethyl group are preferably cited. L and R may be linked together for forming a ring.

The above-mentioned compounds represented by Formulas [H] or [B] are ordinarily used in a form of isolated amine, hydrochlorate salt, sulfate salt, p-toluenesulfonate salt, oxalate salt, phosphorate salt and acetate salt.

In a color developing solution, sulfite salt can be used minutely as a preserver. As aforesaid sulfite salt, sodium sulfite, potassium sulfite, sodium bisulfite and potassium bisulfite are cited.

In the color developing solution, a buffer agent can be used. As a buffer agent, potassium carbonate, sodium carbonate, sodium bicarbonate, potassium bicarbonate, tri-sodium phosphate, tripotassium phosphate, dipotassium phosphate, sodium borate, potassium borate, sodium tetraborate (borate), potassium tetraborate, sodium o-hydroxybenzoate (sodium salicilate), potassium o-hydroxybenzoate, sodium 5-sulfo-2-hydroxybenzoate (sodium 5-salicilate) and potassium 5-sulfo-2-hydroxybenzoate (potassium 5-salicilate) are preferable.

In the color developing solution, a development accelerator can be used. As a development accelerator, thioether-containing compounds, p-phenylenediamine-containing compounds, quartenary ammonium salts, p-aminophenols, amine-containing compounds, polyalkylene oxide, 1-phenyl-3-pyrazolidones, hydrozines, mesoion-type compounds, ion-type compounds and imidazoles can be added as necessary.

As the color developing solution, those substantially not having benzyl alcohol are preferable.

In the color developing solution, a chlorine ion and a bromine ion can be incorporated for preventing fogging. When they are directly added to the color developing solution, the chlorides of sodium, potassium, ammonium, nickel, magnesium, manganese, calcium or cadmium are cited as a chlorine ion providing substances. In addition, they may be incorporated in a form of paired salt of a fluorescent brightening agent added to the color developing solution. On the other hand, bromides of sodium, potassium, ammonium, lithium, magnesium, manganese, calcium, nickel, cadmium, cerium or thallium are cited as a bromine ion providing substances. Of these, the preferable are potassium bromide and sodium bromide.

In the present invention, conventional bleaching solution may be used. In the bleaching solution, a bleaching agent, a peroxide product anti-bleach fogging agent or a halogenated agent may be incorporated.

It is preferable to use bleaching solutions disclosed in Japanese Patent Application No. 296899/1995. Practically, bleaching agent or peroxide products (persulfate salts or hydrogenperoxide) as illustrated as follows are preferable.

| Aminopolycarboxylic acid | Oxidation reduction potential of a processing solution containing ferric (III) complex salt (mV) |
|---|---|
| (A-1) 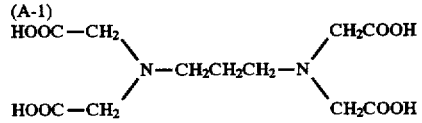 | 250 |
| (A-2) 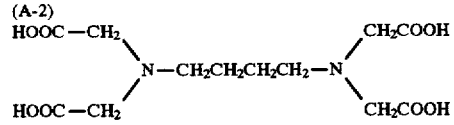 | 220 |

-continued

| Aminopolycarboxylic acid | Oxidation reduction potential of a processing solution containing ferric (III) complex salt (mV) |
|---|---|
| (A-3) $HOOC-CH_2$ \ $N-CH_2CH_2COOH$ / $HOOC-CH_2$ | 200 |
| (A-4) $HOOCH_2C$ \ $CH_2COOH$ / $NCH_2CH_2-N$ / $HOOCH_2CH_2C$ \ $CH_2COOH$ | 200 |
| (A-5) $HOOC-CHNH-CH_2CH_2-NH-CH-COOH$ ; $HOOC-CH_2$ ; $CH_2-COOH$ | 160 |
| (A-6) $HOOC-CHNH-CH_2CH_2CH_2-NH-CH-COOH$ ; $HOOC-CH_2$ ; $CH_2-COOH$ | 230 |
| (A-7) $HOOCCH_2$ \ $CH_2COOH$ / $N-CH_2CH_2OCH_2CH_2OCH_2CH_2-N$ / $HOOCCH_2$ \ $CH_2COOH$ | 230 |

In order to reduce bleaching fogging, it is preferable to use bleaching solution using organic carboxylic acid illustrated as follows (B-1) $HOOCCH_2C(OH)(COOH)CH_2COOH$
(B-2) $HOOC(CHOH)_2COOH$
(B-3) $HOOCCH_2COOH$
(B-4) $HOOCCH(OH)CH_2COOH$
(B-5) $HOOCCH{=}CHCOOH$
(B-6) $HOOCCH_2CH_2COOH$
(B-7) $(COOH)_2$ and containing bromides as a halogenated agent.

In addition, bleach-fixing solutions wherein thiosulfate salt is incorporated are allowed.

Processing time in a processing solution having bleaching ability is preferably 3–30 seconds and more preferably 5–15 seconds.

[Silver halide photographic light-sensitive material]

As examples of light-sensitive material used in the present invention, silver halide color photographic light-sensitive materials containing a silver chloride emulsion and silver halide color photographic light-sensitive materials containing a silver iodide emulsion or a silver bromide emulsion are cited.

EXAMPLE

Hereinafter, the present invention will be explained. These examples shows practical example of the present invention. Therefore, the present invention is not limited thereto. In addition, though there may be definitive expressions, they also represent preferred examples. Therefore, they do not limit the present invention.

Example 1

Figure 2:
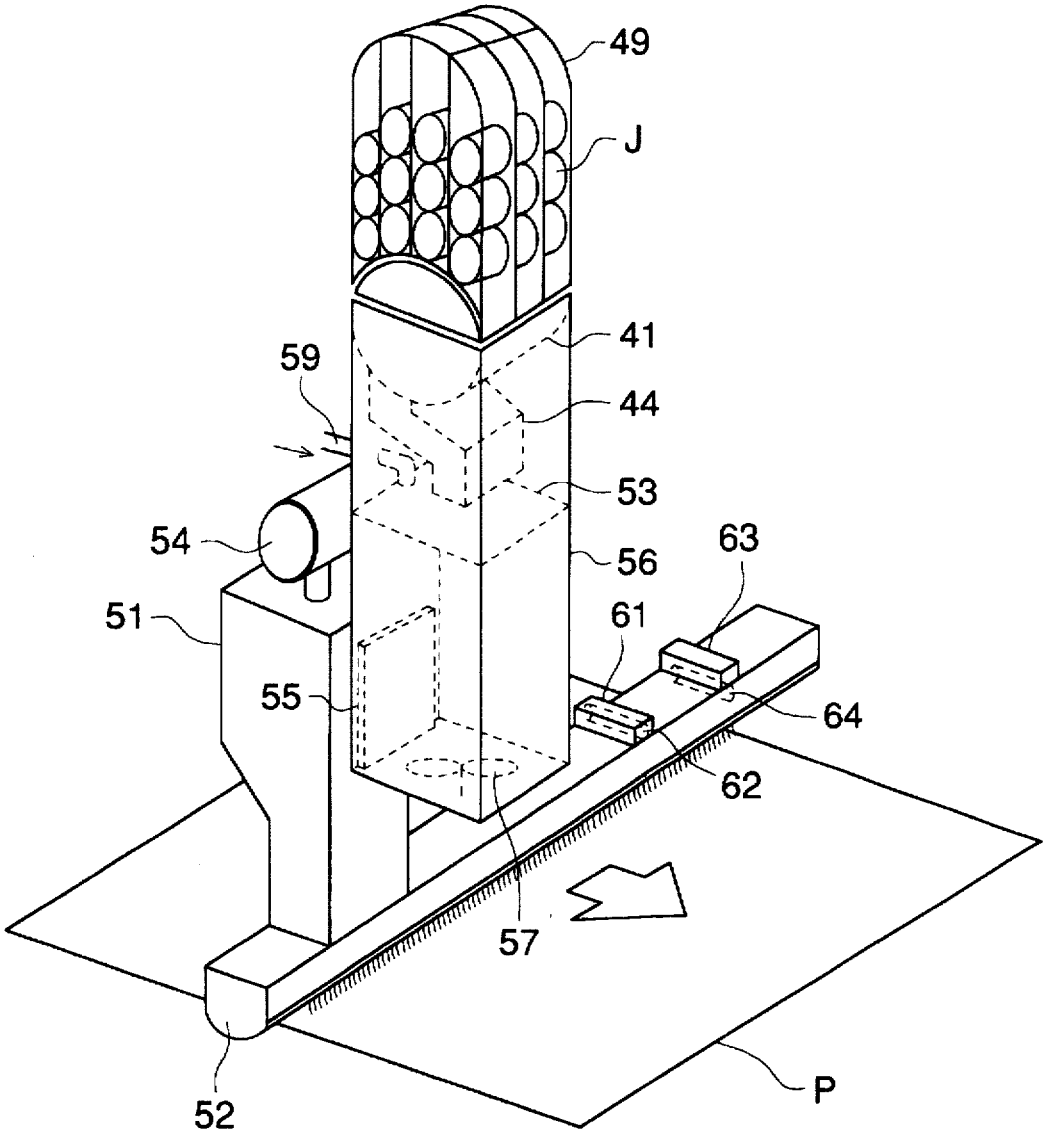
FIG. 2 shows a perspective view of a color developing section of the above-mentioned automatic processing machine.
Figure 3:
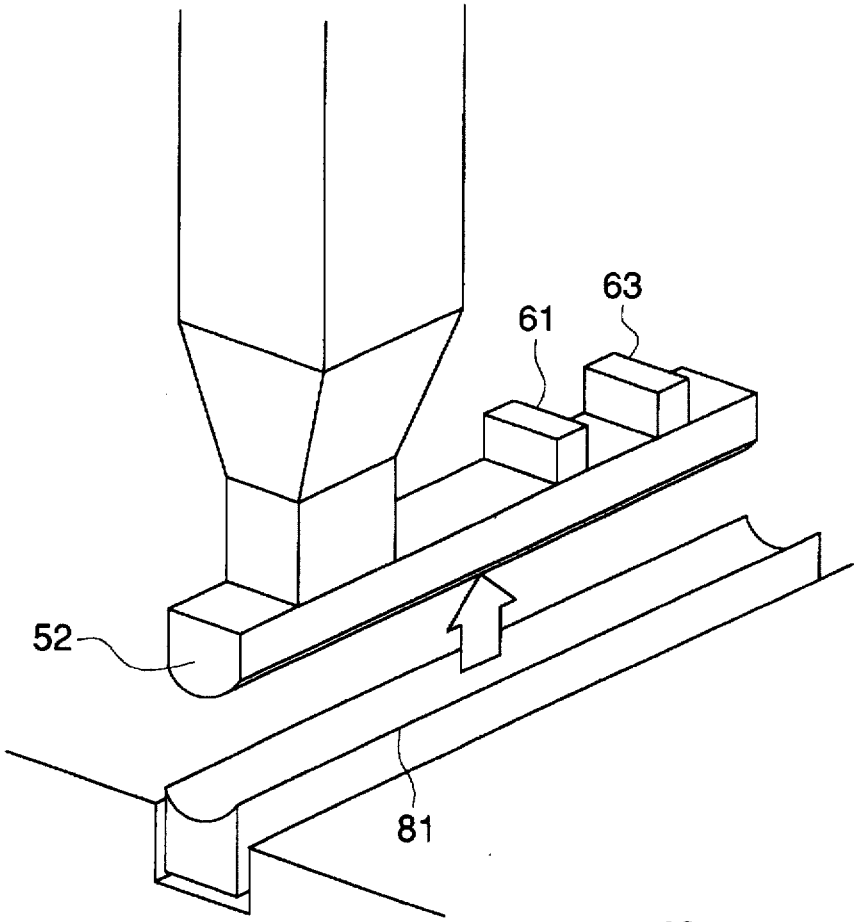
FIGS. 3(*a*) and 3(*b*) shows a perspective view around a drying prevention means for the processing solution feeding port of the above-mentioned processing solution feeding means.
Figure 3:
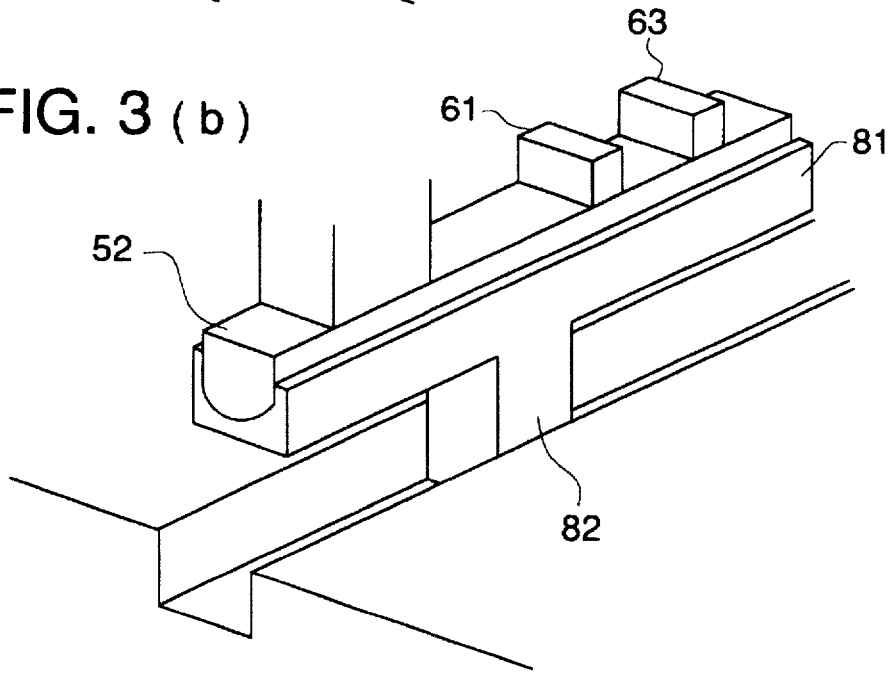

FIG. 1 shows a schematic block diagram of the main portions of the automatic processing machine in Example 1. FIG. 2 shows a perspective view of a color developing section of the automatic processing machine in Example 1. FIG. 3 shows a perspective view in vicinity of drying prevention means for a processing solution feeding port in the automatic processing machine in Example 1.

[Automatic processing machine]

A conveyance means which conveys a silver halide photographic light-sensitive material (light-sensitive material) includes, in addition to a conveyance roller (not illustrated), heating drum 11, pressure belt 15, heating belt 33 and another conveyance roller after a bleach-fixing tank. In addition, there is light-sensitive material sensing means 70 which senses the existence of light-sensitive material P, at a prescribed location in a conveyance direction on the upperstream side from a point where processing solution feeding means 52 feeds a processing solution. On the lowerstream side from light-sensitive material sensing means 70 in the conveyance path of light-sensitive material, heating means 10 which heats light-sensitive material P is provided. In heating means 10, heating drum 11 is provided. Upstream side of heating drum 11, roller 12 on the outlet side is provided. Left of heating drum 11, roller 13 on the inlet side is provided. Left of roller 12 on the outlet side and above roller 13 on the inlet side, pressure belt driving roller 14 is provided. Pressure belt 15 is threaded over roller 12 on the outlet side, roller 13 on the inlet side and pressure belt driving roller 14. Due to the rotation of pressure belt 15 while it is brought into press contact by heating drum 11 with about 90° area of the circumference of heating drum 11. light-sensitive material P is conveyed while it is pressed on heating drum 11. Due to the above-mentioned structure, light-sensitive material P is heated.

Downstream from heating drum 11 in the conveyance path of light-sensitive material P, developing means 50 is provided. Developing means 50 has processing solution container 51 and processing solution replenishing container 56 as processing solution containers which houses the processing solution (color developing solution) processing light-sensitive material P. First processing solution container 51 and second processing solution container 56 are closely tightened against ambient air. As processing solution feeding means 52, a feeding head, described later, is used. Due to this, processing solution feeding means 52 feeds the processing solution (a color developing solution) onto the emulsion surface of light-sensitive material P heated by heating means 10 through gas phase. In addition, Above processing solution container 51 and left of processing solution replenishing container 56, circulation pump 54 is provided and on a partition wall between processing solution container 51 and processing solution replenishing container 56. By actuating circulation pump 54, the color developing solution is caused to circulate in an arrowed direction, i.e., from processing solution container 51 to circulation pump 54, processing solution replenishing container 56 and filter 55. Rotator 57 rotates in processing solution replenishing container 56 so that the processing solution inside processing solution replenishing container 56 is stirred.

Due to the above-mentioned structure, there is a filtration means (filter 55) which is provided between processing solution replenishing container 56 and processing solution feeding means 52 and which filtrates the processing solution from processing solution replenishing container 56. In other words, there is a circulation filtration means (filter 55) which filtrates the processing solution on the downstream side, compared with a region (processing solution replenishing container 56) where the solid processing agent is supplied by processing agent supplying means 40, of the circulation path of the processing solution which circulates by means of the circulation means (circulation pump 54) and on the upperstream side, from a region (first processing solution container 51) where the processing solution fed by processing solution feeding means 52, in the circulation path.

Replenishing water W is fed to processing solution replenishing container 56 from replenishing water feeding means 59. Solid processing agent supplying means 40 which supplies solid processing agent J for silver halide photographic processing solution replenishing container 56 to processing solution replenishing container 56 is provided above processing solution surface 53 of processing solution replenishing container 56. Solid processing agent supplying means 40 has quantitative supplying section 41 which supplies the solid processing agent one by one from solid processing agent container 49 and introduction section 44 which introduces the solid processing agent supplied from quantitative supplying section 41 to the processing solution. By using a tablet as solid processing agent J, quantitativeness is improved and fluctuation of the processing agent component inside the processing solution container can be reduced. Inside solid processing agent container 49 is partitioned to 3 rows and 4 lines (totally, 12 partitions). In each partition, solid processing agents J can be housed in each of rows by wherein the agents contact each other at a point or in a line. Due to this structure, adherence of solid processing agents J can be prevented. Specifically, in the present invention, the volume of the processing solution container can be reduced. For this purpose, the dimension of solid processing agent J can be reduced compared with conventional ones. Accordingly, solid processing agents J are easily adhered each other. Therefore, the above-mentioned structure is specifically useful. Inside quantitative supplying section 41, rotation rotator 42 which rotates is provided. Tablet-receiving section (notch) 43 is provided corresponding to 2 rows in solid processing agent container 49. Every time rotation rotor 42 rotates by 180°, 2 solid processing agent J is received by tablet-receiving section 43. From aforesaid tablet-receiving section (notch) 43, 2 tablets J are supplied to introduction section 44. In this occasion, when the solid processing agent is not supplied, rotation rotor 42 faces introduction section 44 with a portion which is not a notch portion. Therefore, moisture from the processing solution is prevented to invade to solid processing agent container 49 by means of the above-mentioned rotation rotor. Introduction section 44 is almost complete S-shaped, which prevents the splashing up of the solution by vigorously dripping of solid processing agent J on processing solution surface 53 and also prevents coming up of moisture from the processing solution directly to rotation rotor 42 in a large amount. Specifically, in the present invention, the volume of the processing solution containers 51 and 56 can be reduced. For this purpose, the dimension of solid processing agent J can be reduced compared with conventional ones. Accordingly, solid processing agents J each other and with rotation rotor are easily adhered each other. Therefore, the above-mentioned structure is specifically useful.

Processing solution feeding means 52 is provided with the first shutter 62 and the second shutter 64 which stop supply of the processing solution to the feeding head on the way of a width direction of light-sensitive material P. First shutter 62 is driven attachably to or detachably from the feeding path of the processing solution to the feeding head from first shutter driving section 61, and second shutter 64 is driven attachably to or detachably from the feeding path of the processing solution to the feeding head from first shutter driving section 63. FIG. 2 shows status when second shutter 64 is attached to the feeding path of the processing solution to the feeding head.

Below processing solution feeding means 52, drying prevention means 80 for the feeding port which covers the feeding port of the feeding head when the processing solution is not fed onto the light-sensitive material P is provided in order to prevent drying of the processing solution in the feeding port of the feeding head for processing solution feeding means 52. Drying prevention means 80 for the feeding port is composed of movable lid 81, supporting bar 82 which supports movable lid 81 and motor 83 which moves supporting bar 82 upward and downward. Due to providing a gear rack on supporting bar 82 and a pinion gear to motor 83, supporting bar 82 can be driven upward and downward by means of motor 83. Movable lid 81 is concave in the cross-sectional. As described later, processing solution feeding means 52 periodically feed the processing solution even in a stand-by status wherein light-sensitive material P is not processed. In this occasion, movable lid 81 slightly moves downward, movable lid 81 receives a processing solution fed from processing solution feeding means 52 and discharges the processing solution to an effluent section through a hole provided in supporting bar 82 (not illustrated). Due to this, contamination of ambient devices by this processing solution can be prevented.

Second heating means 30, which heats light-sensitive material P, is provided on the downstream side, from a point where the processing solution is fed by processing solution feeding means 52 through gas phase, in the conveyance path of light-sensitive material P. Second heating means 30 has heating roller 31, driving roller 32 and heating belt 33. Heating belt 33 is bridged over heating roller 31 and driving roller 32. Heating roller 31 is located downstream, from a point where the processing solution is fed trough gas phase by processing solution feeding means 22, in the conveyance path of light-sensitive material P, and heats heating belt 33. Due to this, heating belt 33 heats light-sensitive material P while heating belt 33 is heated. Second heating means 30 heats the silver halide photographic light-sensitive material wherein the processing solution is fed onto its emulsion surface through gas phase.

Following this, light-sensitive material P subjected to color developing by developing means 20 is subjected to bleach-fixing in bleach-fixing solution tank BF and also is subjected to stabilizing in stabilizing tank ST.

[Processing solution amount adjusting means]

In advance, density obtained from exposure amount was calculated. Amount of drip is determined corresponding to the maximum density value among B, G and R density values, provided that the dripping amount of the processing solution onto an un-exposed portion, namely Dmin. portion is 0 ml/m$^2$. Namely, as shown in the following Table 1, dripping amount was stepwisely changed against the density value. As comparative examples, 80 ml/m$^2$ was constantly dripped regardless of B, G and R density values.

TABLE 1

| Density region | Dripping amount (ml/m$^2$) |
|---|---|
| 0–0.03 | 0 |
| 0.03–0.35 | 40 |
| 0.35–0.75 | 48 |
| 0.75–1.10 | 56 |
| 1.10–1.45 | 64 |
| 1.45–1.80 | 72 |
| 1.80–2.00 | 80 |
| 2.00 or more | 84 |

[Processing solution feeding head]

Figure 4:
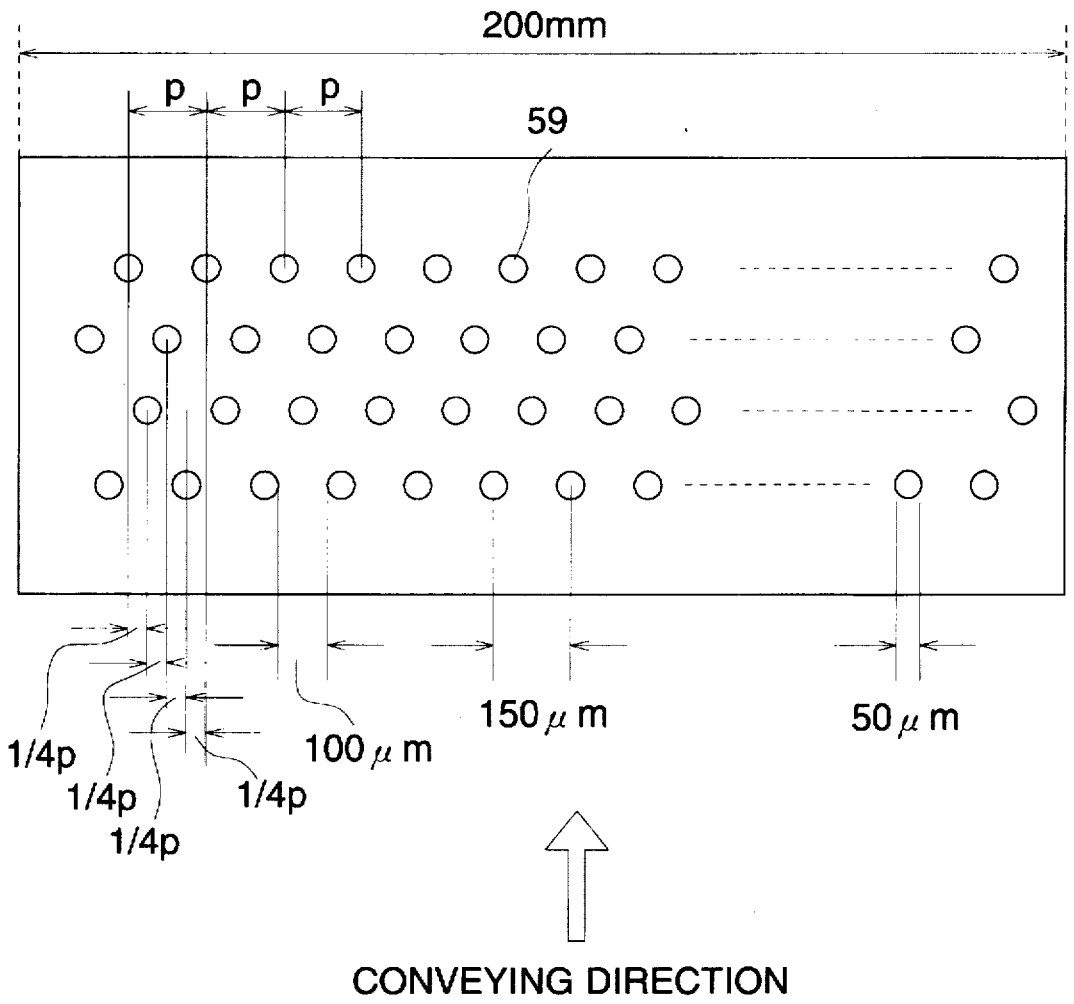
FIG. 4 shows a magnified drawing of orifices front view of the above-mentioned processing solution feeding means (the processing solution feeding head).

FIG. 4 is a magnified drawing of the front of orifice in the above-mentioned processing solution feeding means (a processing solution feeding head) 52. The above-mentioned processing solution feeding means is provided with processing solution chamber 58 for each orifice and a solution drip generation means which sprays solution drip from aforesaid processing solution chamber. Aforesaid solution drip generation means may either be (1) one which sprays solution drips from orifices 59 by changing volume inside processing solution chamber (pressure chamber) 58 due to an electric-mechanical conversion means such as Piezo electric element, or (2) one which causes orifices 59 solution drip from orifices 59 by enhancing processing solution pressure due to generating and swelling bubbles inside the processing solution chamber (pressure chamber) by means of a heating element. These technologies are put into practical use in ink jet printers. Solution drips which are sprayed from orifices 59 and fly through the air are adhered on the emulsion surface of photographic paper p so that latent images formed by the above-mentioned light exposure means are subjected to color developing to form visual images.

The above-mentioned plural orifices 59 are provided in a form of at least two rows. By shifting the first orifice row and the second orifice row by a half pitch, the solution drip density of the lateral direction perpendicular to the conveyance direction of photographic paper is enhanced. The density of plural orifices 59 in the lateral direction is determined by the color developing density to be needed. In addition, plural orifices are not limited to two rows. It may be three or more rows. The above-mentioned solution drip generation means is provided on a side surface of processing solution chambers 58 which communicates orifices 59 or on a plane facing orifices 59.

In Example of the present invention, a bubble jet type feeding head wherein plural orifices 59 are arranged linearly will be used. The arrangement of these plural orifices 59 on the feeding port is a four-row zigzag arrangement. The interval of the feeding port is 100 μm in terms of the distance of the edges of each of two adjacent orifices 59. The diameter of orifice 59 is 50 μm, and the number of feeding the processing solution per second (solution drip spraying number) is 5,000 times. The amount of fed processing solution per one time (volume of one solution drip) is 0.3 pl. In addition, the density of the projected line of orifice row is 624 dpi.

The density of projected line is the number of orifice per unit length (1 inch) when the number of orifice in plural rows of orifices was totalled and regarded as one row.

As a comparative processing solution feeding head, a feeding head provided with one orifice row was also prepared. The diameter and interval of orifices are the same as the above-mentioned Example 1.

[Light-sensitive material]

A photographic paper QA-A6 produced by Konica which was subjected to wedge exposure to light by a conventional method was developed under the following conditions.

[Formula of the processing solution inside a color developing solution container]

Per one liter,

| | |
|---|---|
| Sodium sulfite | 0.05 g |
| Pentasodium diethylene triamine pentaacetic acid | 3.0 g |
| Polyethylene glycol #4000 | 10.0 g |
| Disodium bis(sulfoethyl)hydroxylamine | 12.0 g |
| Chinopal SFP | 2.0 g |
| Potassium carbonate | 33.0 g |
| Sodium p-toluene sulfonic acid | 20.0 g |
| CD-3 | 10.0 g |
| Potassium hydroxide | 5.0 g |

By the use of potassium hydroxide or sulfuric acid, pH was regulated to 11.0.

[Bleach-fixing and stabilizing step]

Under CPK-2-28 processing conditions by Konica Corporation and using processing solutions thereof, a light-sensitive material was subjected to bleach-fixing and stabilizing processing.

[Results]

Light-sensitive materials which were processed using the processing solution feeding heads having plural orifice row resulted in no occurrence of uneven development in which processing can be finished in a short time necessary for solution dripping. In addition, by changing the amount of solution dripping in accordance with image density, the occurrence of stain on white background of the light-sensitive material can be reduced and development stability can be improved. In addition, the amount of processing solution consumption can be kept lower.

Example 2

[Automatic processing machine]

Figure 5:
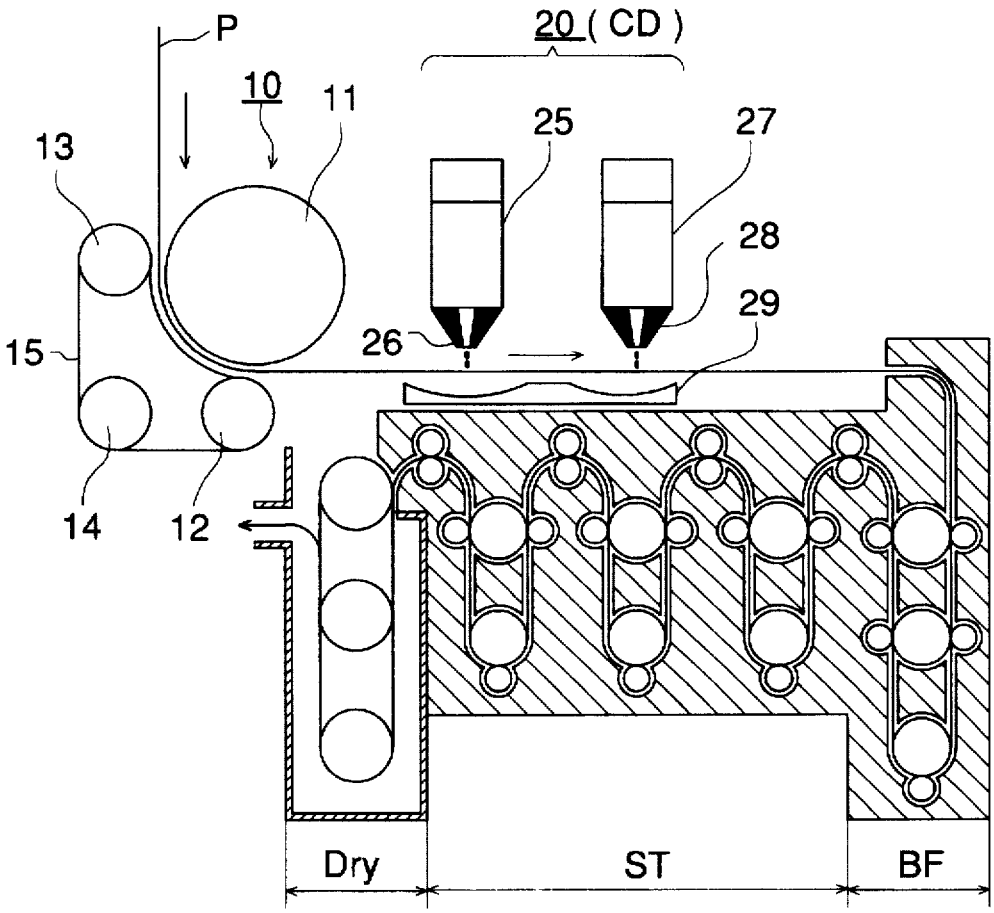
FIG. 5 shows a schematic block diagram of the main portions of the automatic processing machine in Example 2 of the present invention.

FIG. 5 shows a schematic block diagram of main portions of the automatic processing machine of Example 2. On the upstream side from light-sensitive material P which will be processed by the processing solution, heating means 10 which heats light-sensitive material P is provided. In heating means 10, heating drum 11, which heats the light-sensitive material from the emulsion surface thereof, is provided. Below heating drum 11, roller 12 on the outlet side is provided. Left of heating drum 11, roller 13 on the inlet side is provided. Left of roller 12 on the outlet side and below roller 13 on the inlet side, pressure belt driving roller 14 is provided. Pressure belt 15 is bridged over roller 12 on the outlet side, roller 13 on the inlet side and pressure belt driving roller 14. Due to the rotation of pressure belt 15 while it is brought into press contact by heating drum 11 with about 90° area of the circumference of heating drum 11. light-sensitive material P is conveyed while it is pressed on heating drum 11. Due to the above-mentioned structure, light-sensitive material P is heated.

Downstream from heating drum 11 in the conveyance path of light-sensitive material P, developing means 20 is provided. Developing means 20 has first processing solution container 25 which houses a low pH color developing solution for processing light-sensitive material P and second processing solution container 56 which houses a high pH color developing solution for processing light-sensitive material P, as processing solution containers which houses the processing solution processing light-sensitive material P. As first processing solution feeding means 26 which feeds the processing solution housed in the first processing solution container 25 and as second processing solution feeding means 28 which feeds the processing solution housed in the second processing solution container, a feeding head, described later, is respectively used. Due to this, first processing solution feeding means 26 and second processing solution feeding means 28 feeds the color developing solution onto the emulsion surface of light-sensitive material P heated by heating means 10 through gas phase. The processing solution overflowed from light-sensitive material P is discharged to the effluent section (not illustrated) by receiving plate 29.

Light-sensitive material P subjected to color developing by developing means 20 is subjected to bleach-fixing in bleach-fixing solution tank BF, subjected to stabilizing processing in stabilizing tank ST and also subjected to drying in a drying section Dry.

[Heating condition][feeding head]

They are identical to Example 1.

[Light-sensitive material]

A photographic paper QA-A6 produced by Konica which was subjected to exposure to light by a conventional method was developed under the following conditions.

[Formula of processing solution inside the first processing solution container]

Per 1 liter

| | |
|---|---|
| Sodium sulfite | 1.0 g |
| Disodium bis(sulfoethyl)hydroxylamine | 12.0 g |
| CD-3 | 30.0 g |

pH was regulated to 2–3 by the use of potassium hydroxide or sulfuric acid.

[Formula of processing solution inside the second processing solution container]

Per 1 liter

| | |
|---|---|
| Sodium sulfite | 0.05 g |
| Potassium carbonate | 100.0 g |
| Pentasodium diethylene triamine pentaacetic acid | 3.0 g |
| Polyethylene glycol #4000 | 10.0 g |
| Disodium bis(sulfoethyl)hydroxylamine | 12.0 g |
| Chinopal SFP | 2.0 g |
| Sodium p-toluenesulfonic acid | 20.0 g |

pH was regulated to 11.0 by the use of potassium hydroxide or sulfuric acid.

[Bleach fixing and stabilizing step]

Under conditions of CPK-2-28 processing by Konica Corporation, a light-sensitive material was processed using processing solution used for the same processing.

[Processing solution adjusting means]

The processing is the same as Example 1. The amount of dripping of the first developing solution and the second processing solution will be changed as shown in Table 2. As a comparative example, 40 ml/m$^2$ was dripped constantly regardless of B, G and R density. For processing solution feeding means 26 and 28, one having the same structure as processing solution feeding head 52 in Example 1 was used.

TABLE 2

| Density region | Amount of dripping (ml/m$^2$) |
|---|---|
| 0–0.03 | 0 |
| 0.03–0.35 | 20 |
| 0.35–0.75 | 24 |
| 0.75–1.10 | 28 |
| 1.10–1.45 | 32 |
| 1.45–1.80 | 36 |
| 1.80–2.00 | 40 |
| 2.00 or more | 42 |

[Results]

Light-sensitive materials which were processed using the processing solution feeding heads having plural orifice row resulted in no occurrence of uneven development and shortening processing time necessary for solution dripping.

Example 3

In the processing solution amount adjusting means in Example 2, the degree of overlapping solution drips was changed as shown in Table 3 so that density unevenness was observed. In addition, light-sensitive material P used was exposed to gray light, causing its density to be 0.3.

The degree of overlapping of the solution drop in the conveyance direction (a longitudinal direction) of light-sensitive material P will now be explained. For example, by arranging that the follower row orifice sprays when the orifice in the former row is firstly sprayed and the row of the solution drop of the former row is conveyed to arrive at in the vicinity of the orifice row of follower row, the solution drop row in the follower row can be overlapped on the solution drop row of the former row. The degree of overlapping is defined to be D/S provided that the area of the solution drop of one dot is S and the area where aforesaid solution drops overlap the surrounding solution drops is D, which can be regulated by changing the timing of spraying of the orifice row in the follower row against that of the former row.

The degree of overlapping solution drops in the lateral direction of light-sensitive material P can be regulated by changing the pitch of plural rows of orifices to be zigzag form and concurrently with this by changing the area of the solution drop of one dot S.

TABLE 3

| Degree of Overlapping | Density (Blue) | Development unevenness |
|---|---|---|
| 0 | 0.25 | C |
| 0.1 | 0.28 | B |
| 0.2 | 0.30 | A |
| 0.3 | 0.31 | A |
| 0.5 | 0.31 | A |
| 1.0 | 0.31 | A |
| 3.0 | 0.32 | A |
| 4.0 | 0.33 | A |
| 5.0 | 0.34 | B |

NOTE:
Mark A represents excellent.
Mark B represents acceptable.
Mark C represents unacceptable.

As is understood from Table 3, by setting the degree of overlapping solution drips to 0.2 or more, a prescribed development density can be formed so that development unevenness can be minimized.

Example 4

In processing solution feeding means 26 and 28 in Example 2, the projected line density of the orifices row was changed as shown in Table 4, and evaluation identical to Example 2 was conducted. Incidentally, dot line density of light-sensitive material in the conveyance direction due to the above-mentioned processing solution feeding means 26 and 28 was 156 dpi in the case of minimum dripping amount.

TABLE 4

| Projected line density of orifices row (dpi) | Density | Development unevenness |
|---|---|---|
| 78 | 0.25 | C |
| 156 | 0.30 | B |
| 318 | 0.30 | A |
| 636 | 0.31 | A |

NOTE:
Mark A represents excellent.
Mark B represents acceptable.
Mark C represents unacceptable.

As is understood from Table 4, by enhancing the projected line density of orifices row compared with the dot line density of light-sensitive material P in the conveyance direction by processing solution feeding means 26 and 28, development unevenness can be improved.

Example 5

Though, in the Example 2, a light-sensitive material was subjected to bleach-fixing in bleach-fixing processing solution tank BF after color developing processing, in the Example 5, a bleaching solution having the following composition was fed to a feeding head which was identical to one used in color developing processing, and then, dripped under the following conditions for bleaching processing. Following this, the light-sensitive material was subjecte to fixing in a fixing processing tank, stabilizing in stabilizing processing tank ST and also to drying in a drying section.

[Heating conditions][Feeding head]

Figure 6:
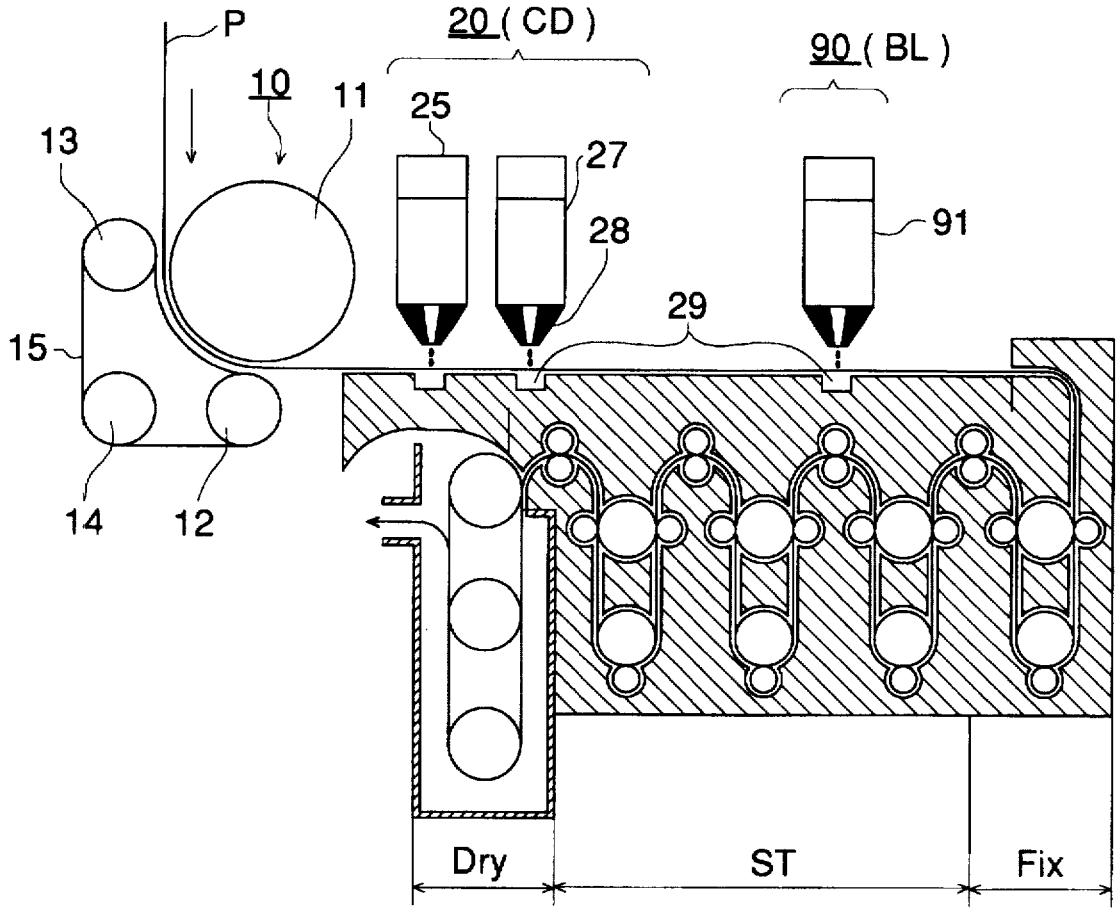
FIG. 6 shows a schematic block diagram of the main portions of the automatic processing machine in Example 5 of the present invention.

The light-sensitive material was processed in an automatic processing machine shown in FIG. 6. Processing times and processing temperatures were as follows:

| | | |
|---|---|---|
| CD | 10 seconds | 50° C. |
| BL | 5 seconds | 50° C. |
| Fix | 5 seconds | 38° C. |
| Stab | 10 seconds | 38° C. |

With regard to the feeding head, the one identical to Example 2 was employed.

Formula of the processing solution inside a bleaching solution container

Per 1 liter:

| | |
|---|---|
| PDTA-Fe | 100 g |
| $NH_4Br$ | 40 g |
| Succinic acid | 60 g |
| PDTA-4H | 6 g |

By the use of potassium carbonate and sulfuric acid, pH was regulated to 4.0.

Fixing solution tank solution

| | |
|---|---|
| Ammonium thiosulfate | 100 g |
| Ammonium sulfite | 10 g |
| Imidazole | 10 g |
| EDTA-2Na | 1 g |

By the use of potassium hydroxide or sulfuric acid, pH was regulated to 7.0.

Processing solution regulating means

Processing solutions were regulated in the same manner as in Example 2. The dripping amount of the bleaching solution when the degree of overlapping was 0.5 is shown in Table 5. In addition, the dripped amount of color developing solution was the same as in Example 2.

TABLE 5

| Density region | Amount dripped |
|---|---|
| 0–0.03 | 0 |
| 0.03–0.75 | 15 ml/m$^2$ |
| 0.75–1.5 | 18 |
| 1.5 or more | 20 |

While changing the degree of solution drip as shown in the following Table 6, the residual silver amount on Dmax portion was measured by means of a fluorescent X-ray method.

TABLE 6

| Degree of overlapping | Density of residual silver (mg/m$^2$) |
|---|---|
| 0 | 10 |
| 0.1 | 5 |
| 0.2 | 3 |
| 0.5 | 3 |
| 1.0 | 3 |
| 2.0 | 3 |
| 3.0 | 3 |

As is understood from Table 6, favorable bleaching performance can be resulted in by setting the degree of solution drop overlap to be 0.2 or more, in the bleaching step too.

As described above, when the amount of processing solution feeding is regulated (specifically, image signals corresponding to low density) in accordance with image signals which are recorded on the light-sensitive material, plural orifices rows are provided, the dripping amount of processing solution per unit area is changed uncontinously and aforesaid dripping amount is caused to correspond with image signals Accordingly, the amount of processing solution in a low density portion can be reduced and development unevenness can be minimized.

It is not necessary to feed a processing solution on a white background portion. Accordingly, the occurrence of stains due to oxidized product of the color developing agent can completely be prevented.

Development unevenness can be prevented both in low density and high density. Accordingly, stable developability can be obtained even if processing temperature fluctuates.

What is claimed is:

1. An apparatus for processing a silver halide photographic material which is exposed to a light; comprising conveying means for conveying the silver halide photographic material in a predetermined conveying direction;

supplying means having a supplying head on which plural jetting orifices are provided, the supplying head located so as to be spaced from the silver halide photographic material conveyed by the conveying means and jetting a processing solution through a space from the plural jetting orifices onto the silver halide photographic material so that plural solution dots are formed on the silver halide photographic material;

regulating means for regulating an amount of the processing solution in accordance with the image signal so that the amount of the processing solution supplied through each of the plural jetting orifices of the supplying head is regulated from a minimum amount to a maximum amount;

the plural jetting orifices provided in such an arrangement when the amount of the processing solution supplied through each of the plural jetting orifices is the minimum amount, that the plural jetting orifices are located in a jetting region on the supplying head, a total number of the plural jetting orifices is N, the jetting region has a length L (inch) in a direction perpendicular to the conveying direction, an orifice density is defined by a formula (N/L), a dot density in the conveying direction is a number of dots per inch in the conveying direction and the orifice density is larger than the dot density, and that each solution dot on the silver halide photographic material has a dot area S and a overlapping area D in which neighboring solution dots are overlapped with each other and a degree of overlapping defined by a formula (D/S) is not less than 0.2, wherein the regulating means regulates the amount of the processing solution stepwise in accordance with the density level of the image signal, and wherein the regulating means makes the amount of the processing solution nil when the density level of the image signal is lower than a predetermined level.

2. The apparatus of claim 1, wherein the degree of overlapping is 0.2 to 4.0.

3. The apparatus of claim 1, wherein the degree of overlapping is 0.3 to 3.0.

4. The apparatus of claim 1, wherein the plural jetting orifices are separated into at least two rows and plural jetting orifices of each row are aligned in a direction perpendicular to the conveying direction so that at least a first and second jetting orifice rows are formed on the supplying head by the plural jetting orifices.

5. The apparatus of claim 4, wherein a jetting timing of the second jetting orifice row is delayed from a jetting timing of the first jetting orifice row so that solution dots formed by the second jetting orifice row are overlapped in the conveying direction on solution dots formed by the first jetting orifice row.

6. The apparatus of claim 4, wherein a position of each jetting orifice of the second jetting orifice row is staggered in relation to a position of each jetting orifice of the first jetting orifice row so that solution dots formed by the second jetting orifice row are overlapped in the direction perpendicular to the conveying direction on solution dots formed by the first jetting orifice row.

7. The apparatus of claim 4, wherein the plural jetting orifices are separated into 2 to 6 rows.

8. The apparatus of claim 1, wherein a number of steps is 1 to 20.

9. The apparatus of claim 1, wherein a number of steps is 3 to 10.

10. The apparatus of claim 1, wherein the processing solution is a color developing solution.

11. The apparatus of claim 1, wherein the processing solution is a bleaching solution.

* * * * *